US006715480B2

(12) United States Patent
Dziob

(10) Patent No.: US 6,715,480 B2
(45) Date of Patent: Apr. 6, 2004

(54) HIGH FLOW BOLT FOR PAINTBALL MARKER

(75) Inventor: David F. Dziob, Meriden, CT (US)

(73) Assignee: New Designz, Meriden, CT (US)

( * ) Notice: Subject to any disclaimer, the term of this patent is extended or adjusted under 35 U.S.C. 154(b) by 0 days.

(21) Appl. No.: 10/185,367

(22) Filed: Jun. 27, 2002

(65) Prior Publication Data

US 2004/0000301 A1 Jan. 1, 2004

(51) Int. Cl.[7] ..... F41B 11/00
(52) U.S. Cl. ..... 124/73
(58) Field of Search ..... 124/73–76, 71, 124/1

(56) References Cited

U.S. PATENT DOCUMENTS

| | | | | |
|---|---|---|---|---|
| 3,662,729 A | | 5/1972 | Henderson | 124/11 |
| 5,228,427 A | | 7/1993 | Gardner, Jr. | 124/71 |
| 5,280,778 A | | 1/1994 | Kotsiopoulos | 124/73 |
| 5,327,878 A | | 7/1994 | Wittbrot | 124/41.1 |
| 5,881,707 A | | 3/1999 | Gardner, Jr. | 124/77 |
| 6,213,112 B1 | * | 4/2001 | Squire | 124/74 |

OTHER PUBLICATIONS

U.S. patent application 20020046748, Apr. 2002, Hernandez.*

New DeSIGNZ "Equalizer" bolt for the Impulse (http://www.kamworld.net/paintball/reviews/equalizer.html), Jun. 2002.*

AKA Low pressure system for the Auto/Minicocker, 1998, Ravi Chopra.*

Lightning Bolt, May 2000, Jay Murray.*

DEZign Bolts for the Autococker and Angel, Feb. 2001, Sean Kelly.*

IPB Delrin Bolt, Apr. 2001, author unknown.* www.newdesignz.com, Jan. 2002.*

Shocker World publication regarding Shocker Functional Overview, pp. 1–3, by Jack Hand, Document No. AA, dtd. May 30, 2002.

3 Photographic Images of Marker Bolts, Document Nos. AB–AD, dtd. May 30, 2002.

* cited by examiner

*Primary Examiner*—Michael J. Carone
*Assistant Examiner*—Troy Chambers
(74) *Attorney, Agent, or Firm*—Alix, Yale & Ristas, LLP

(57) ABSTRACT

A high flow bolt for a paintball marker increases the efficiency of energy transfer from a propellant charge to the paintball projectile by increasing the flow rate of propellant through the bolt. Gradual transitions, increased sectional area flow passages and an equalizing chamber synergistically combine to improve the efficiency of the marker by up to 30% or more. A more efficient marker provides more shots per unit of propellant.

17 Claims, 3 Drawing Sheets

HIGH FLOW BOLT FOR PAINTBALL MARKER

BACKGROUND OF THE INVENTION

1. Field of the Invention

This invention relates to pneumatically operated projectile launching devices and more particularly to a bolt for such a projectile launching device including fluid flow passages configured to significantly improve the efficiency of energy transfer from a propellant gas to the projectile.

2. Description of the Related Art

Paintball is a popular recreational activity that may be played in a variety of indoor or outdoor environments. Typically, the object of the game is to capture the flag of an opposing team. Players are eliminated when "marked" by paint from a pneumatically fired paint ball. The ball is designed to rupture and splatter paint on the stricken player. The equipment used to fire the paintballs are referred to as "markers". Paintball markers launch the paintballs by releasing a burst of gas (typically $CO_2$ or compressed air) under pressure into a barrel behind the paintball projectile.

The development of paintball markers has been characterized by continuing efforts to improve their ease of use, reliability, accuracy and efficiency. Efficiency as used in the context of this application is intended to describe the quantity of compressed gas required to propel a paintball projectile at a predetermined velocity. The quantity of gas used is primarily a function of the input pressure, which is adjusted by a regulator between the reservoir of compressed gas and the internal mechanisms of the marker. Generally speaking, higher input pressure translates into higher paintball velocity from the marker. The rules of organized paintball games typically restrict the maximum velocity to between 280 and 300 feet per second close, e.g., within 1 to 2 feet of the muzzle of the paintball marker.

Efficiency is important to a paintball player because the power source for the paintball marker is a cartridge or bottle of compressed gas mounted to the marker. Continuing efforts have been made to reduce the size and weight while increasing the capacity of these cartridges or bottles. However, their capacity is inherently limited and a player can quite literally run out of gas. A paintball marker with improved efficiency may permit either reduction in the size and therefore weight of the compressed gas reservoir or permit the firing of more shots from a gas reservoir of the given size, or both.

Most paintball markers share some common components and are similar in some ways to a firearm or airgun. For example, the paintball projectile is fired out of a barrel, which extends from a generally closed breech end to an open muzzle end. The paintball marker typically includes a grip and utilizes a trigger to initiate launching of the paintball projectile. A reservoir or magazine of paintball projectiles is typically mounted above the breech of the paintball marker. Paintballs are typically fed into the breech of the marker by gravity, although other feeding mechanisms are available.

Many paintball markers are semi-automatic, e.g., a new projectile is loaded into firing position automatically, immediately after launch of a preceding paintball. Such paintball markers typically utilize a reciprocating bolt. The bolt serves two primary functions. First, the bolt cycles between a loading position in which the outlet of the projectile magazine is uncovered permitting a paintball to drop into the breech of the paintball marker; and a launch position in which the bolt moves toward the muzzle of the marker, covering the magazine outlet. Second, when in the "launch" position, the bolt re-directs a charge of compressed gas released from a chamber in the marker to propel the paintball out the muzzle end of the barrel toward a target. The expanding gas of the propellant charge transfers energy to the projectile, expelling it from the barrel of the marker. It is the efficiency of this energy transfer that ultimately determines what quantity, i.e., pressure of propellant charge is required to propel a paintball at a given velocity.

There is a need in the art for a paintball marker bolt that maximizes the efficiency of energy transfer from the released gas to a paintball projectile.

SUMMARY OF THE INVENTION

A bolt in accordance with the present invention improves the efficiency of energy transfer from the propellant charge to a paintball projectile in part by reconfiguring the gas flow passages through the bolt to reduce energy loss due to turbulence. The compactness typical of a paintball marker does not permit the propellant charge pass longitudinally from the internal reservoir through the length of the bolt and down the barrel. In a common configuration, the propellant charge enters the bolt generally perpendicular to the bolt/barrel axis through a port or opening in the side of the bolt. The flow direction of the propellant charge must be re-directed from an orientation perpendicular to the barrel to a direction aligned with the barrel.

Typical prior art bolts utilize a right-angle junction defined by the intersection of perpendicular flow passages. Such an abrupt change of direction creates turbulence in the propellant charge and robs it of energy. According to a first embodiment of a first aspect of the present invention, a marker bolt utilizes an angled inlet passage to eliminate the "corner" formed at the intersection of the prior art perpendicular flow passages. This transition passage configuration simultaneously reduces the "dead" volume within the bolt and reduces turbulence in the propellant charge during its change of direction. In combination, the reduced volume and turbulence of the bolt inlet transition passage reduce energy loss during the change of propellant charge direction.

Typical prior art marker bolts use a plurality of circular bores to connect the bolt inlet to the projectile end of the bolt. Such circular passages are easily machined, but make poor use of the available sectional flow area within the bolt. The resulting restricted flow path unnecessarily reduces the mass flow rate of the propulsion charge through the bolt.

According to a first embodiment of a second aspect of the present invention, a high efficiency marker bolt utilizes a plurality of equiangularly spaced, circumferentially extended longitudinal flow passages to connect the bolt inlet to the projectile end of the bolt. The passages are kidney-shaped or eliptical when viewed in section. Such passages dramatically increase the flow area through the bolt. This increased flow area presents less resistance to the propellant charge, permitting a larger quantity of propellant gas to move longitudinally through the bolt per unit of time.

The energy required to expel the paintball from the muzzle of the marker at a given velocity must be derived from the propellant charge. An object of the present invention is to provide a new and improved marker bolt that improves the efficiency of this energy transfer by minimizing the energy lost to turbulence and increasing the flow rate of the propellant charge through the bolt. These objects are achieved, in part by increasing the sectional flow area of the bolt available for longitudinal flow of the propellant charge.

Less restricted gas flow permits a larger volume of the propellant charge to act on the projectile in a shorter period of time. This larger volume may in fact have a somewhat slower velocity in the longitudinal flow passages when compared to the restricted flow passages of the prior art. However, the larger volume of propellant charge reaching the projectile can accomplish more useful work, e.g., accelerating the projectile than is possible with the prior art bolt.

According to a first embodiment of a third aspect of the present invention, a high efficiency marker bolt provides a chamber connecting the longitudinal flow passages at the forward or projectile end of the bolt. This chamber serves at least two functions. First, it gives the propellant charge room to accumulate before the paintball begins to move. This room to expand smoothes the flow of the propellant charge through the marker bolt. In contrast, many prior art bolts are configured such that the paintball seats against the projectile end of the bolt, effectively covering the outlets of the circular longitudinal passages. This configuration requires displacement of the paintball before further propellant can move through the bolt. Also, covering the longitudinal passages may cause pressure waves to reflect off the paint ball back into the oncoming propellant charge. Such reflected pressure waves sap energy from the propellant charge.

Second, the chamber recombines the propellant charge portions travelling in the longitudinal flow passages into a single, more balanced volume of propellant that acts substantially uniformly on a large surface area of the paintball. Prior art bolts may impart undesirable spin to the paintball by directing unequal, high velocity streams of propellant at the is paintball. Spin on the paintball can adversely effect the accuracy of the marker.

Prior art marker bolts illustrate a chamber adjacent the projectile end of a marker bolt formed by a larger circular bore connecting the several smaller circular longitudinal passages in the bolt. The larger bore ends abruptly at an end face perpendicular to the longitudinal passages. Thus, a sharp right angle transition occurs between the longitudinal passage and the chamber. Such a configuration is easily machined but imparts turbulence to the propellant charge as it emerges from the longitudinal passages. As previously discussed, turbulence saps energy from the propellant charge that would otherwise be available for delivery to the paintball.

One embodiment of an equalizing chamber in accordance with the present invention provides an arcuate or hemispherical end face to the large circular bore defining the chamber. The intersection of the circumferentially extending longitudinal passages and the hemispherical end face of the equalizing chamber is more gradual, and therefore imparts less turbulence to the propellant charge.

An object of the present invention is to provide a new and improved bolt for a pneumatically operated projectile-launching device that reduces the quantity of compressed gas required to propel a projectile of a given configuration and mass from the barrel of a marker at a given velocity.

Another object of the present invention is to provide a new and improved bolt for a pneumatically operated projectile-launching device which improves the accuracy of the device by improving the consistency of the projectile trajectory.

A further object of the present invention is to provide a new and improved bolt for a pneumatically operated projectile-launching device that reduces turbulence in a charge of compressed gas used to launch the projectile.

BRIEF DESCRIPTION OF THE DRAWINGS

These and other objects, features and advantages of the invention will become readily apparent to those skilled in the art upon reading the description of the embodiments, in conjunction with the accompanying drawings, in which.

DETAILED DESCRIPTION OF THE INVENTION

Figure 2:
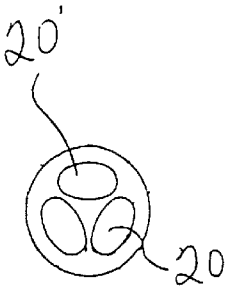
FIG. 2 is a right end view of the marker bolt of FIG. 1.
Figure 1:
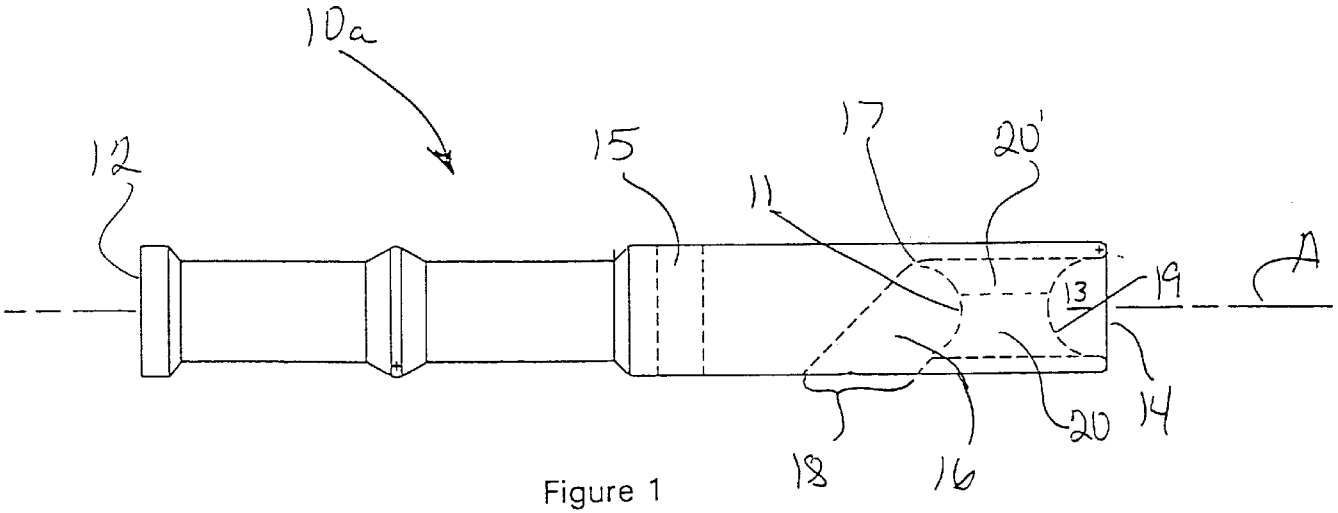
FIG. 1 is a side view, partly in phantom, of a first embodiment of an inventive marker bolt according to several aspects of the invention.
Figure 3:
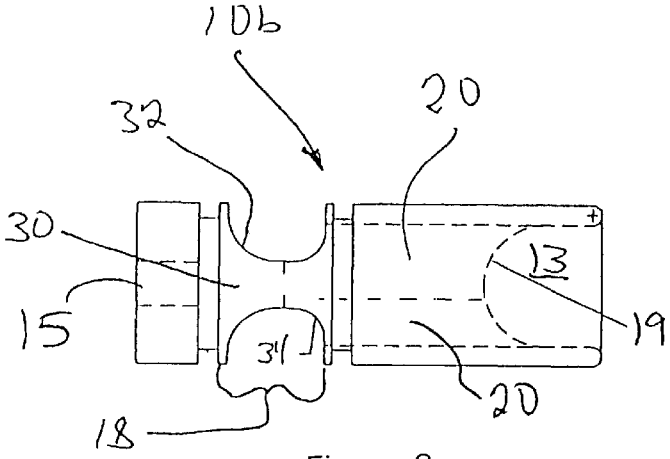
FIG. 3 is a side view, partly in phantom, of a second embodiment of an inventive marker bolt according to several aspects of the invention.
Figure 4:
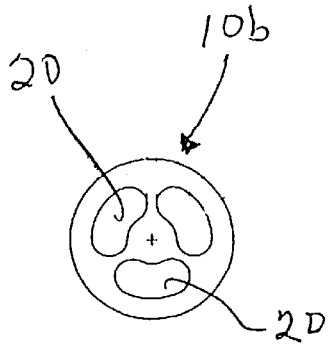
FIG. 4 is a right end view of the marker bolt of FIG. 3.
Figure 5:
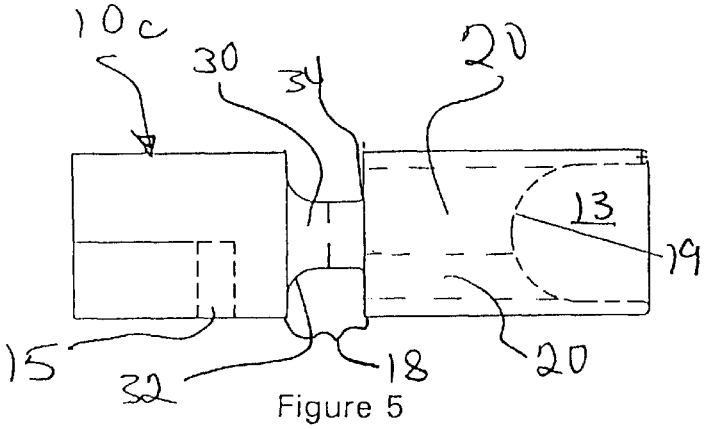
FIG. 5 is a side view, partly in phantom, of a third embodiment of an inventive marker bolt according to several aspects of the invention.
Figure 6:
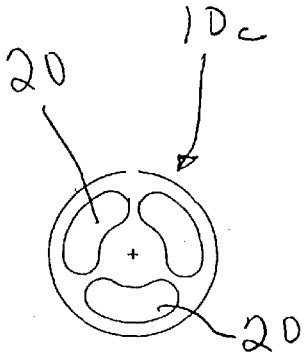
FIG. 6 is a right end view of the marker bolt of FIG. 6.

FIGS. 1 and 2 illustrate a first embodiment of a marker bolt 10*a* according to several aspects of the invention. This first embodiment of a marker bolt is configured for use in conjunction with an Impulse™ marker. The marker bolt 10*a* extends from a rear or breech end 12 to a forward or projectile end 14. A bore 15 vertically bisects the bolt 10*a* for reception of a rod (not shown) linked to the mechanism (not shown) that reciprocates the bolt 10*a* between a loading position and a launching position. The rod also maintains a particular orientation between the bolt 10*a* and the surrounding breech portion of the marker.

In an Impulse™ marker, the propellant charge enters the bolt 10*a* at inlet 18 and travels down transition passage 16. The transition passage 16 alters the direction of the propellant charge from a direction generally perpendicular to the bolt axis A to a direction parallel to the bolt axis A. The inventive angled transition passage 16 decreases the volume of the inlet by approximately 9% by eliminating the squared junction of the inlet and flow passages in the prior art bolt. The volume of a transition passage according to one aspect of the invention is preferably less than approximately 0.11 $in^3$. This reduced volume is more rapidly filled than the prior art passage configuration. The transition passage 16 has an oblique, e.g., non-right angle orientation relative to the axis A of the bolt.

It will be apparent that, even in the inventive configuration, propellant charge entering the inlet 18 toward the breech end 12 of the bolt has a longer distance to travel before entering a flow passage 20' than propellant charge entering toward the projectile end 14 of the bolt. If the bolt were hollow, such differences would cause a swirling turbulence in the propellant charge. Any energy consumed by this swirling turbulence must be taken from the energy available in the propellant charge. The three septums or dividers 21 between the flow passages 20 prevent accumulation of such swirling turbulence by straightening the propellant charge as it flows longitudinally.

To further address pressure differentials resulting from the above discussed distance differences, the inventive marker bolt 10*a* aligns flow passage 20' laterally across that portion of the transition passage 16 having the greatest length. This arrangement presents a large, uninterrupted circumferential dimension of flow passage 20' to the propellant charge having the longest distance to travel. A smooth junction 17 between the transition passage 16 and the flow passage 20' further enhances flow of propellant charge into passage 20'. The result of these features is a smoother, more balanced and less turbulent flow of propellant charge through the inlet 18, transition passage 16 and into the flow passages 20', 20.

It should be noted that both the entrance 11 and exit 19 of the flow passages 20 are defined by generally hemispherical surfaces as best seen in FIG. 1. Abrupt, large area changes in passage configuration are avoided by the inventive passage shapes, while carefully smoothed junctions, such as 17 reduce energy sapping turbulence and increase flow.

As best seen in FIG. 2, the flow passages 20 are generally elliptical or oval in section. These shape passages provide a larger flow area from the area available within the bolt 10*a* when compared to the round bores of the prior art bolt. In the Impulse™ bolt, the inventive configuration results in an increase in sectional flow area of approximately 10%. Each of the flow passages 20 in the illustrated bolt 10*a* has a sectional area of approximately 0.0525 $in^2$. The three flow passages have a combined sectional area of approximately 0.1575 $in^2$. A larger sectional flow area permits a greater volume of propellant charge to traverse the bolt 10*a* in a given period of time. This increased flow rate, in combination with reduced turbulence, permits more work to be accomplished by an equivalent charge of propellant gas, e.g., these features result in improved efficiency.

The flow passages 20', 20 open into an equalizing chamber 13 adjacent the projectile end 14 of the bolt. This equalizing chamber 13 allows the divided propellant charge to accumulate and re-combine prior to movement of the paintball projectile. This re-combination and accumulation helps balance the force exerted on the paintball. This can be contrasted with many prior art marker bolts, which configure the projectile end of the bolt to cup the paintball. Such an arrangement covers the outlets of the respective round bores. Covered outlets require that the paintball move prior to any recombination of the propellant charge. Any inequality of pressure in the respective flow passages of a prior art bolt are delivered directly to the paintball. This may impart undesirable spin to the projectile which will adversely effect the consistency, range and accuracy of the marker.

For marker bolt 10*a*, the volume of the equalizing chamber has a volume of approximately 0.06 $in^3$ or roughly 13% of the volume of a standard 0.68" paintball. (A standard 0.68" or 68 caliber paintball has a volume of approximately 0.484 $in^3$.) The volume of the equalizing chamber 13 is measured from the hemispherical wall defining the exits 19 of the flow passages 20 to the projectile end 14 of the bolt 10*a*. The prior art discloses generally smaller volume equalizing chambers that provide little or no free space when a paintball is seated against the projectile end of the bolt. According to one aspect of the invention, the equalizing chamber has a volume of at least approximately 0.06 $in^3$ or at least approximately 13% of the volume of a standard 0.68" paintball.

The inventive marker bolts are preferably machined from plastic rod stock. A preferred plastic is Delrin™ manufactured by E.I. du Pont de Nemours & Company. Delrin™ is a family of acetal resins known for their dimensional stability, stiffness, fatigue and corrosion resistance. This plastic material, in combination with the substantially open internal configuration discussed above, result in a lighter bolt. Since the bolt reciprocates inside the marker for every shot, a lighter bolt a) requires less propellant gas to be cycled, b) improves cycling time due to less inertia, and c) delivers less "kick" to the marker. Feature a) improves efficiency, feature b) reduces the time between shots and feature c) improves accuracy by reducing movement of the marker during firing. Delrin™ does not require lubrication, reducing the maintenance for a marker equipped with the inventive bolt. Further, in contrast to an aluminum bolt, the inventive plastic bolt is softer than the surrounding parts of the marker, with the result that if abrasive materials get into the breech, the bolt will wear rather than the barrel of the marker.

Testing shows that the inventive marker bolt improves paintball velocity by up to 20–30 feet per second (FPS) over stock aluminum bolts. Since most paintball games restrict the maximum velocity from a marker, this increased efficiency of energy delivery to the paintball allows the player to reduce the input pressure to the marker and use less propellant per shot.

Testing also shows that the consistency of paintball speed from a marker equipped with the inventive bolt is improved. In other words, the spread between the slowest paintball and the fastest paintball in a group is reduced. This improved consistency improves accuracy by making each shot more predictable. Improved consistency also helps the paintball player more closely approach the maximum allowable velocity without fear that some shots will exceed the allowed velocity.

FIGS. 3–8 illustrate additional related embodiments of the inventive marker bolt designed for use with the Shocker™ (FIGS. 3, 4 and 8) and Angel™ (FIGS. 5 and 6) markers respectively. These bolts 10*b*, 10*c* incorporate the equalizing chamber 13 with hemispherical rear wall 19 and the circumferentially extended flow passages 20 having improved flow area as discussed above. These features generally contribute the same advantages to the Shocker™ and Angel™ markers as they did for the Impulse™ marker. For purposes of illustration, the illustrated embodiment of the Shocker™ bolt 10*b* has an equalizing chamber 13 with a volume of approximately 0.11 $in^3$ or at least approximately 20% of the volume of a standard 0.68" paintball. The illustrated embodiment of the Angel™ bolt has an equalizing chamber 13 with a volume of approximately 0.16 $in^3$ or at least approximately 30% of the volume of a standard 0.68" paintball. These volumes, in combination with the hemispherical wall that defines the outlets 19 of the flow passages 20 leave room for re-combination and accumulation of the propellant charge even when the paintball is seated against the projectile end 14 of the bolt.

Figure 7:
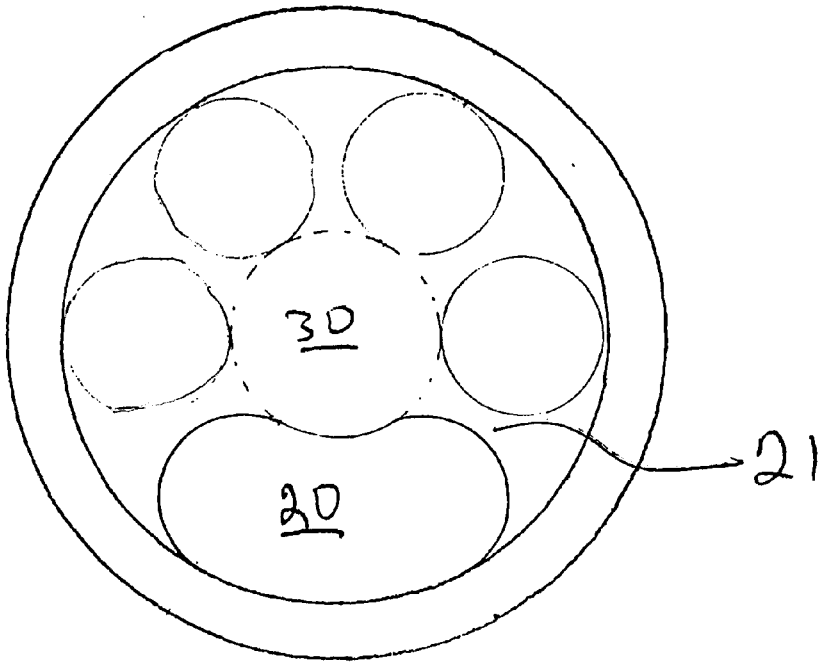
FIG. 7, is an enlarged projectile end view of a representative marker bolt contrasting a prior art flow passage configuration with a flow passage according to an aspect of the invention.
Figure 8:
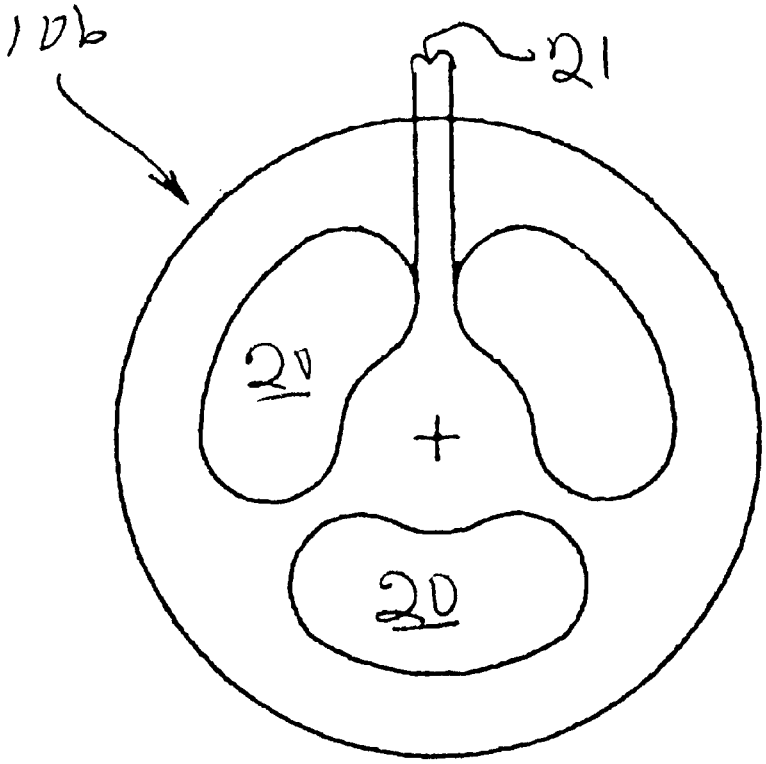
FIG. 8 is an enlargement of FIG. 4 shown for the purposes of contrast with FIG. 7.

In bolts 10*b* and 10*c*, the inlet 18 is defined by an opening surrounding a central shaft 30 of the bolt. Propellant gas is released into this circumferential opening where it changes direction into the longitudinal flow passages 20. The central shaft 30 of the inventive bolts are radiused outwardly at their respective junctions with the breech end is 12 and the projectile end 14 of the bolts 10*b*, 10*c*. According to one aspect of the invention, the diameter of the breech end radius 32 is larger than the projectile end radius 34. This shaft configuration assists the transition in direction of the propellant charge in the inlet opening FIGS. 7 and 8 contrast the flow passage configuration of the prior art Shocker™ bolt with the inventive bolt 10*b*. In the prior art Shocker™ bolt, six circular flow passages, four of which are shown at the top of FIG. 7, surrounded the central shaft 30. As shown at the bottom of FIG. 7, the circumferentially extended, kidney-shaped flow passage 20 in accordance with one aspect of the present invention eliminate a septum 21 and the associated bolt material around it. The inventive kidney-shaped flow passage configuration increases the flow area through the bolt by approximately 30% over the prior art six circular bore configuration. The illustrated bolt 10*b* defines three kidney-shaped flow passages, each having a sectional area of approximately 0.0417 $in^2$. The three passages 20 together provide a sectional area of approximately 0.1251 $in^2$. This greatly increased flow area has all the advantages previously discussed.

The stock Angel™ bolt (not illustrated) uses a pattern of eight small circular flow passages arranged around the perimeter of the projectile end of the bolt. The inventive flow passage configuration illustrated in FIG. 6 increases the flow area by approximately 80% over the stock flow passage pattern. The illustrated bolt 10*c* defines three flow passages, each having a sectional area of approximately 0.0558 $in^2$. Combined, the three flow passages 20 provide a sectional area of approximately 0.1674 $in^2$.

Marker bolt 10*b* includes an axial threaded bore 15 for connection with the bolt-reciprocating mechanism of the Shocker™ marker. Marker bolt 10*c* includes a bore 15 for connection with the bolt-reciprocating mechanism of the Angel™ marker. It will be noted that the Shocker arrangement does not index the bolt to any particular rotational position relative to the breech of the marker, while the Angel™ arrangement does limit rotation of the bolt in the breech. As a result, the Angel™ bolt may be configured to include an angled inlet passage similar to that illustrated in FIG. 1. Such modification is intended to be within the scope of the present invention.

While several embodiments demonstrating aspects of the present invention have been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. A bolt for a pneumatically operated projectile launching device having a barrel extending from a muzzle end to a generally cylindrical breech, said bolt comprising:

a body having an axis and extending from a breech end to a projectile end, said body defining an inlet opening and a plurality of non circular flow passages fluidly connecting said inlet opening to a chamber adjacent said projectile end, each of said passages having a substantially constant cross-sectional area measured perpendicular to said axis of at least approximately 0.04 $in^2$.

2. The bolt of claim 1, wherein each of said flow passages has a circumferential extent and a radial extent and said circumferential extent is greater than the radial extent.

3. The bolt of claim 1, wherein each of said flow passages is generally elliptical in cross-section.

4. The bolt of claim 1, wherein each of said flow passages is generally kidney-shaped in cross-section.

5. The bolt of claim 1, wherein said body defines a transition passage extending from said inlet opening to said flow passages, said transition passage being oriented at an oblique angle relative to said axis.

6. The bolt of claim 5, wherein each of said flow passages has a circumferential extent and a radial extent and said circumferential extent is greater than the radial extent, said angled orientation resulting in said transition passage having a length which varies from a first length to a second length, said first length being shorter than said second length and that portion of said transition passage associated with said second length is generally aligned with the circumferential extend of one of said flow passages.

7. The bolt of claim 1, wherein said chamber has a volume of at least approximately 0.06 $in^3$.

8. The bolt of claim 1, wherein said chamber has a volume in the range of between 0.06 $in^3$ and 0.16 $in^3$.

9. The bolt of claim 1, wherein said chamber is defined a generally hemispherical surface intersecting the outlets of said flow passages.

10. A bolt for a pneumatically operated device for launching a projectile, said bolt mounted for reciprocation within the breech of said device, said bolt having a breech end and a projectile end, said bolt comprising:

a body having an axis and defining an inlet opening intermediate said breech end and said projectile end, a generally hemispherical chamber adjacent said projectile end and three longitudinally extending flow passages communicating between said inlet opening and said chamber, said chamber having a volume of at least approximately 0.06 $in^3$, each of said flow passages being non-circular in cross-section.

11. The bolt of claim 10, wherein each of said flow passages has a circumferential dimension and a radial dimension, said circumferential dimension being greater than said radial dimension.

12. The bolt of claim 11, wherein each of said flow passages is substantially elliptical in cross-section.

13. The bolt of claim 11, wherein each of said flow passages is substantially kidney-shaped in cross-section.

14. The bolt of claim 10, comprising a transition passage connecting said inlet opening to said flow passages, said transition passage having an oblique angular orientation with respect to said axis.

15. The bolt of claim 10, wherein said chamber has a volume in the range of between 0.06 $in^3$ and 0.17 $in^3$.

16. The bolt of claim 10, wherein each of said flow passages has a cross-sectional area of at least 0.04 $in^2$.

17. The bolt of claim 14, wherein said transition passage has a volume of less than 0.11 $in^3$.

* * * * *